US010185339B2

(12) United States Patent
Fazeel et al.

(10) Patent No.: US 10,185,339 B2
(45) Date of Patent: Jan. 22, 2019

(54) FEEDFORWARD CANCELLATION OF POWER SUPPLY NOISE IN A VOLTAGE REGULATOR

(71) Applicant: TEXAS INSTRUMENTS INCORPORATED, Dallas, TX (US)

(72) Inventors: Shuaeb Fazeel, Bangalore (IN); Eeshan Miglani, Bangalore (IN); Visvesvaraya Pentakota, Bangalore (IN); Shagun Dusad, Bangalore (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 35 days.

(21) Appl. No.: 14/446,815

(22) Filed: Jul. 30, 2014

(65) Prior Publication Data

US 2015/0077070 A1 Mar. 19, 2015

(30) Foreign Application Priority Data

Sep. 18, 2013 (IN) ..... 4183/CHE/2013

(51) Int. Cl.

| | |
|---|---|
| ***G05F 1/575*** | (2006.01) |
| *G05F 3/22* | (2006.01) |
| *G05F 1/46* | (2006.01) |
| *G05F 3/24* | (2006.01) |

(52) U.S. Cl.

CPC ..... *G05F 1/575* (2013.01); *G05F 1/467* (2013.01); *G05F 3/222* (2013.01); *G05F 3/242* (2013.01)

(58) Field of Classification Search

CPC ..... G05F 1/575; G05F 1/467; G05F 3/222; G05F 3/242; H02M 3/07; H02M 3/28; H02M 3/33523; H02M 5/2573; H02M 7/538; H02M 7/217; H02M 7/90

See application file for complete search history.

(56) References Cited

U.S. PATENT DOCUMENTS

| | | | | |
|---|---|---|---|---|
| 4,484,148 | A | 11/1984 | Wieser et al. | |
| 5,120,996 | A * | 6/1992 | Mead | G06N 3/063 327/94 |
| 6,437,628 | B1 * | 8/2002 | Davenport | H03K 19/018514 327/112 |
| 6,448,750 | B1 * | 9/2002 | Shor | G05F 1/575 323/282 |
| 6,977,490 | B1 * | 12/2005 | Zhang | G05F 1/575 323/280 |

(Continued)

OTHER PUBLICATIONS

B.K. Ahuja, "An Improved Frequency Compensation Technique for CMOS Operational Amplifiers", IEEE Journal of Solid-State, vol. SC-18, No. 6, Dec. 1983, pp. 629-633.

*Primary Examiner* — Gary L Laxton
*Assistant Examiner* — Demetries A Gibson
(74) *Attorney, Agent, or Firm* — Andrew Viger; Charles A. Brill; Frank D. Cimino

(57) ABSTRACT

A voltage regulator that provides feedforward cancellation of power supply noise is disclosed. The voltage regulator includes a process tracking circuit that receives a supply voltage and generates a proportional voltage. A tracking capacitor is coupled to the process tracking circuit and generates an injection voltage based on the proportional voltage. An Ahuja compensated regulator generates a regulated voltage. The injection voltage is provided on a feedback path of the Ahuja compensated regulator.

23 Claims, 3 Drawing Sheets

(56) References Cited

U.S. PATENT DOCUMENTS

| | | | | |
|---|---|---|---|---|
| 7,173,402 | B2 * | 2/2007 | Chen | G05F 1/575 323/274 |
| 7,205,827 | B2 * | 4/2007 | Leung | G05F 1/575 323/280 |
| 8,154,263 | B1 * | 4/2012 | Shi | G05F 1/575 323/269 |
| 2003/0011350 | A1 * | 1/2003 | Gregorius | G05F 1/575 323/282 |
| 2006/0125456 | A1 * | 6/2006 | Wu | H02M 1/38 323/282 |
| 2009/0128107 | A1 * | 5/2009 | Wang | G05F 1/575 323/280 |
| 2011/0181258 | A1 * | 7/2011 | Ivanov | G05F 1/56 323/282 |
| 2012/0262135 | A1 * | 10/2012 | Childs | G05F 1/575 323/269 |
| 2013/0099764 | A1 * | 4/2013 | Zhang | G05F 1/575 323/273 |
| 2013/0134788 | A1 * | 5/2013 | Noguchi | H02J 1/00 307/75 |
| 2014/0103893 | A1 * | 4/2014 | Bhattad | G05F 1/575 323/273 |
| 2014/0176098 | A1 * | 6/2014 | Fang | G05F 1/575 323/280 |
| 2014/0266100 | A1 * | 9/2014 | Cavallini | G05F 1/575 323/273 |

* cited by examiner

FEEDFORWARD CANCELLATION OF POWER SUPPLY NOISE IN A VOLTAGE REGULATOR

CROSS REFERENCES TO RELATED APPLICATIONS

This application claims priority from India Provisional Patent Application No. 4183/CHE/2013 filed on Sep. 18, 2013, which is hereby incorporated by reference in its entirety.

TECHNICAL FIELD

The disclosure relates to voltage regulators and more particularly to feedforward cancellation of power supply noise and enhancing power supply rejection ratio (PSRR) in voltage regulators.

BACKGROUND

A voltage regulator is placed between a power supply and a load circuit for providing a regulated voltage (constant voltage) to the load circuit regardless of fluctuations in the power supply. The voltage regulator can supply the regulated voltage to the load circuit as long as the output voltage of the power supply is greater than the regulated voltage supplied to the load circuit.

A measure of the effectiveness of the voltage regulator is its power supply rejection ratio (PSRR), which is a ratio of amount of noise present on the power supply that is provided to the voltage regulator and the amount of noise which is provided to the load circuit by the voltage regulator. A high PSRR is indicative of a low amount of transmission of noise in the regulated voltage, and a low PSRR is indicative of a high amount of noise transmission in the regulated voltage. A high PSRR, particularly across a wide range of operating frequencies of the devices being supplied by the voltage regulator, is difficult to achieve.

The enormous demand for portable electronic devices such as tablet computers, mobile phones, personal digital assistants (PDAs), and/or portable media players has pushed demand for SoCs (system-on-chip) in which large number of analog and digital circuit are fabricated on a same die. However, these SoCs suffer from noise which arises from sources such as switching of digital circuits, RF blocks and voltage converters.

This noise affects the power supplies through crosstalk and deteriorates the performance of the analog and digital circuits such as PLL, amplifiers and VCO. This in turn, deleteriously impacts critical system specifications like the selectivity of the receiver, spectral purity of the transmitter, and phase error tolerance of digital circuits. Therefore, the voltage regulators are required to safeguard noise-sensitive blocks (analog and digital) from high frequency fluctuations in the power supply. This makes the design of voltage regulators that have a high PSRR (power supply rejection ratio) over a wide frequency range extremely critical for high system performance.

SUMMARY

This Summary is provided to comply with 37 C.F.R. § 1.73, requiring a summary of the invention briefly indicating the nature and substance of the invention. It is submitted with the understanding that it will not be used to interpret or limit the scope or meaning of the claims.

An embodiment provides a voltage regulator. The voltage regulator includes a process tracking circuit that receives a supply voltage and generates a proportional voltage. A tracking capacitor is coupled to the process tracking circuit and generates an injection voltage based on the proportional voltage. An Ahuja compensated regulator generates a regulated voltage. The injection voltage is provided on a feedback path of the Ahuja compensated regulator.

Other aspects and example embodiments are provided in the Drawings and the Detailed Description that follows.

BRIEF DESCRIPTION OF THE VIEWS OF DRAWINGS

DETAILED DESCRIPTION OF THE EMBODIMENTS

Figure 1:
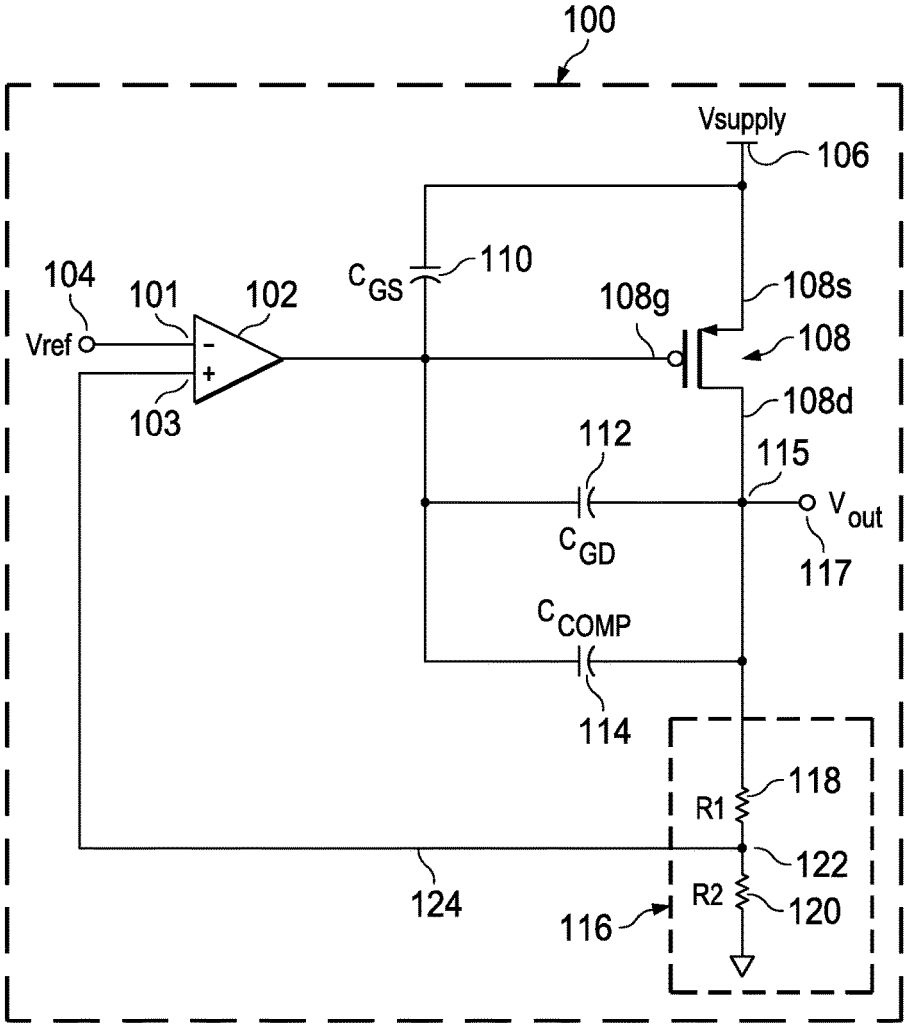
FIG. 1 illustrates a schematic of a miller compensated regulator.

FIG. 1 illustrates a schematic of a miller compensated regulator 100. The miller compensated regulator 100 includes an error amplifier 102. The error amplifier 102 includes an input node 101 and a feedback node 103. The input node 101 receives a reference voltage Vref 104. A pass transistor 108 is coupled to the error amplifier 102. A source terminal 108*s* of the pass transistor 108 is coupled to a supply voltage Vsupply 106. A gate terminal 108*g* of the pass transistor 108 is coupled to the error amplifier 102. A compensation capacitor $C_{COMP}$ 114 is coupled between the gate terminal 108*g* and a drain terminal 108*d* of the pass transistor 108.

The pass transistor 108 is associated with parasitic capacitances. A first parasitic capacitance $C_{GS}$ 110 is between the source terminal 108*s* and the gate terminal 108*g* of the pass transistor 108. A second parasitic capacitance $C_{GD}$ 112 is between the gate terminal 108*g* and the drain terminal 108*d* of the pass transistor 108. An output node 115 is coupled to the drain terminal 108*d* of the pass transistor 108. A regulated voltage Vout 117 is generated at the output node 115.

A voltage divider circuit 116 is coupled to the drain terminal 108*d* of the pass transistor 108. The voltage divider circuit 116 includes a first resistor R1 118 and a second resistor R2 120. A node 122, between the first resistor R1 118 and the second resistor R2 120, is coupled to the feedback node 103 of the error amplifier 102. One end of the second resistor R2 120 is coupled to a ground potential. The voltage divider circuit 116 and a path 124 form a feedback path of the Miller compensated regulator 100.

The operation of the miller compensated regulator 100 illustrated in FIG. 1 is explained now. The miller compensated regulator 100 generates the regulated voltage Vout 117. The regulated voltage Vout 117 is proportional to the reference voltage Vref 104. The miller compensated regulator 100 can supply high load currents at output node 115 drawing current from supply voltage Vsupply 106. The error amplifier 102 amplifies a voltage difference between the reference voltage Vref 104 and a feedback voltage received at the feedback node 103. The error amplifier 102 generates an amplified voltage which is provided to the pass transistor 108. The pass transistor 108 also receives the supply voltage Vsupply 106. The regulated voltage Vout 117 is generated at the drain terminal 108*d* of the pass transistor and at the output node 115. The voltage divider circuit 116 receives the regulated voltage Vout 117 and generates the feedback voltage at node 122 which is provided to the error amplifier 102.

The miller compensated regulator 100 maintains a level of the regulated voltage Vout 117 when the supply voltage Vsupply 106 varies. When the supply voltage Vsupply 106 varies, it causes a change in the level of the regulated voltage Vout 117. The feedback voltage at node 122 varies because of the change in the supply voltage Vsupply 106. The feedback voltage is provided at the feedback node 103 which is compared with the reference voltage Vref 104. The amplified voltage generated by the error amplifier 102 varies to maintain the level of the regulated voltage Vout 117. The error between the reference voltage Vref 104 and the feedback voltage received at feedback node 103 modulates the amplified voltage at the gate terminal 108*g* of the pass transistor 108 to keep the regulated voltage Vout 117 fixed with respect to the reference voltage Vref 104 irrespective of changes in the supply voltage Vsupply 106 and a load current drawn at output node 115.

The compensation capacitor $C_{COMP}$ 114 stabilizes a response of the feedback path and improves a phase margin of the feedback path. Power supply rejection ratio (PSRR) of the miller compensated regulator 100 is dependent on the compensation capacitor $C_{COMP}$ 114 and the first parasitic capacitance $C_{GS}$ 110. Thus, the PSRR of the miller compensated regulator 100 degrades at high frequencies. A corner frequency for PSRR of 6 dB (decibels) is given as:

$$F = \frac{gm}{2\pi C_{COMP}} \tag{1}$$

where gm is a transconductance of the error amplifier 102. Thus, the transconductance gm of the error amplifier 102 has to be increased to increase bandwidth of the miller compensated regulator 100 which entails increasing the power burned in the miller compensated regulator 100.

Figure 2:
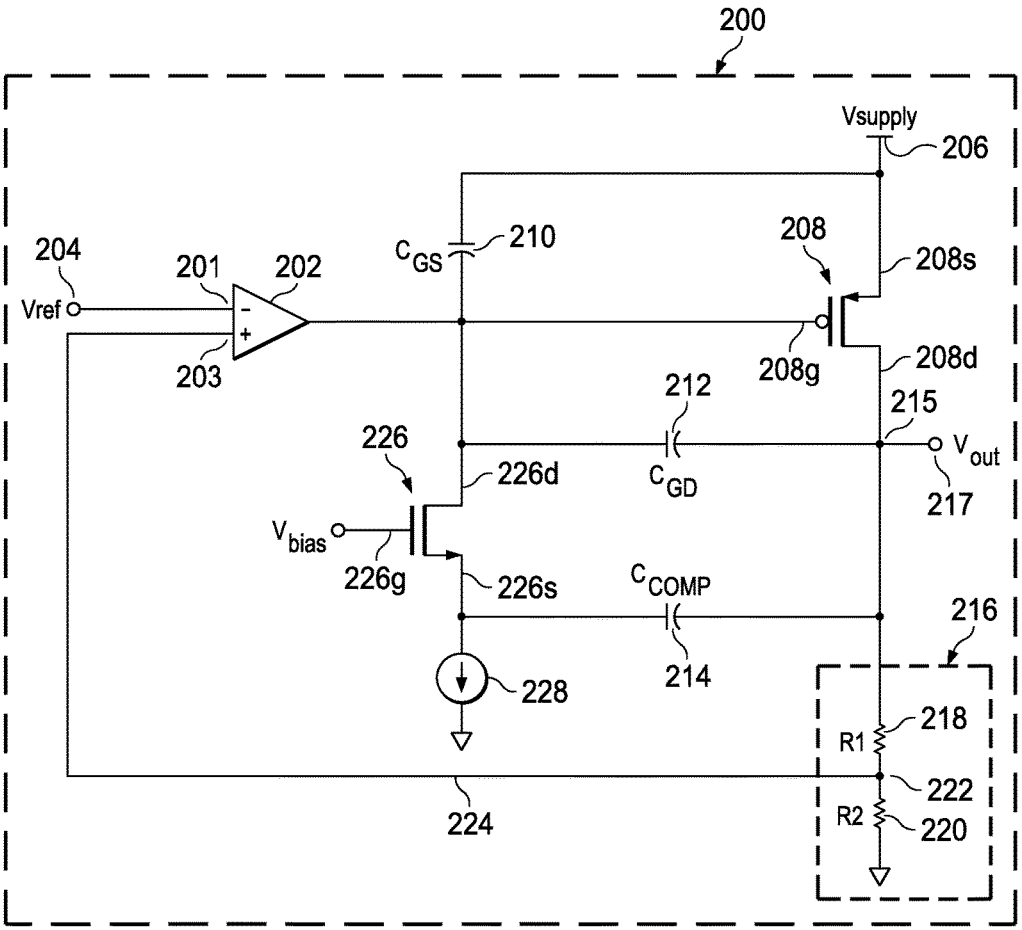
FIG. 2 illustrates a schematic of an Ahuja compensated regulator.

FIG. 2 illustrates a schematic of an Ahuja compensated regulator 200. The Ahuja compensated regulator 200 includes an error amplifier 202. The error amplifier 202 includes an input node 201 and a feedback node 203. The input node 201 receives a reference voltage Vref 204. A pass transistor 208 is coupled to the error amplifier 202. A source terminal 208*s* of the pass transistor 208 is coupled to a supply voltage Vsupply 206. A gate terminal 208*g* of the pass transistor 208 is coupled to the error amplifier 202. An NMOS (n-metal oxide semiconductor) transistor 226 is coupled to the error amplifier 202. A gate terminal 226*g* of the NMOS transistor 226 receives a bias voltage Vbias. A current source 228 is coupled to a source terminal 226*s* of the NMOS transistor 226. One end of the current source 228 is coupled to a ground potential. A compensation capacitor $C_{COMP}$ 214 is coupled between the source terminal 226*s* of the NMOS transistor 226 and a drain terminal 208*d* of the pass transistor 208.

The pass transistor 208 is associated with parasitic capacitances. A first parasitic capacitance $C_{GS}$ 210 is between the source terminal 208*s* and the gate terminal 208*g* of the pass transistor 208. A second parasitic capacitance $C_{GD}$ 212 is between the gate terminal 208*g* and the drain terminal 208*d* of the pass transistor 208. An output node 215 is coupled to the drain terminal 208*d* of the pass transistor 208. A regulated voltage Vout 217 is generated at the output node 215.

A voltage divider circuit 216 is coupled to the drain terminal 208*d* of the pass transistor 208. The voltage divider circuit 216 includes a first resistor R1 218 and a second resistor R2 220. A node 222 between the first resistor R1 218 and the second resistor R2 220 is coupled to the feedback node 203 of the error amplifier 202. One end of the second resistor R2 220 is coupled to the ground potential. The voltage divider circuit 216 and a path 224 form the feedback path of the Ahuja compensated regulator 200.

The operation of the Ahuja compensated regulator 200 illustrated in FIG. 2 is explained now. The error amplifier 202 amplifies a voltage difference between the reference voltage Vref 204 and a feedback voltage received at the feedback node 203. The error amplifier 202 generates an amplified voltage which is provided to the pass transistor 208. The pass transistor 208 also receives a supply voltage Vsupply 206. A regulated voltage Vout 217 is generated at the drain terminal 208*d* of the pass transistor 208 and at the output node 215. The voltage divider circuit 216 receives the regulated voltage Vout 217 and generates the feedback voltage at node 222 which is provided to the error amplifier 202.

The Ahuja compensated regulator 200 maintains a level of the regulated voltage Vout 217 when the supply voltage Vsupply 206 varies. When the supply voltage Vsupply 206 varies, it causes a change in the level of the regulated voltage Vout 217. The feedback voltage at node 222 varies because of the change in the supply voltage Vsupply 206. The feedback voltage is provided at the feedback node 203 which is compared with the reference voltage Vref 204. The amplified voltage generated by the error amplifier 202 varies to maintain the level of the regulated voltage Vout 217.

The compensation capacitor $C_{COMP}$ 214 stabilizes a response of the feedback path and improves a phase margin of the feedback path. However, the compensation capacitor $C_{COMP}$ 214 is not in a direct path of the supply voltage Vsupply 206 and the regulated voltage Vout 217. Therefore, a power supply rejection ratio (PSRR) of the Ahuja compensated regulator 200 is not degraded by the compensation capacitor $C_{COMP}$ 214. The PSRR of the Ahuja compensated regulator 200 is higher than the miller compensated regulator 100 illustrated in FIG. 1. The Ahuja compensated regulator 200 is capable of high frequency rejection of PSRR. The PSRR of the Ahuja compensated regulator 200 is dependent on the second parasitic capacitance $C_{GD}$ 212. A corner frequency for PSRR of 6 dB (decibels) is given as:

$$F = \frac{gm}{2\pi C_{GD}} \tag{2}$$

where gm is a transconductance of the error amplifier 202. Therefore, the PSRR is limited by second parasitic capacitance $C_{GD}$ 212 which is much lesser than capacitance of the compensation capacitor $C_{COMP}$ 214. The compensation capacitor $C_{COMP}$ 214 also provides high frequency rejection through the NMOS transistor 226. A change in regulated voltage Vout 217 is fed back to modulate the amplified voltage at the gate terminal 208*g* of the pass transistor 208 providing high frequency negative feedback.

Figure 3:
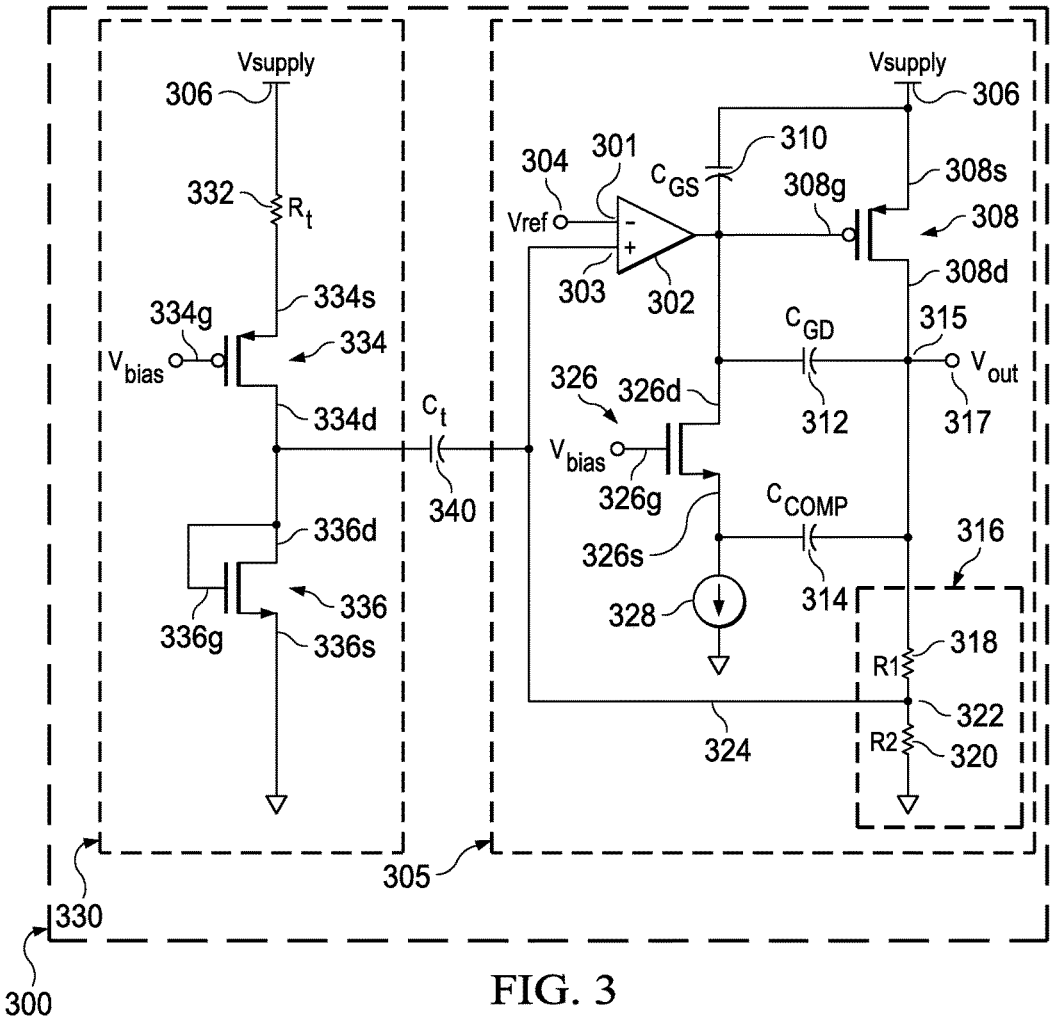
FIG. 3 illustrates a schematic of a voltage regulator, according to an embodiment.

FIG. 3 illustrates a schematic of a voltage regulator 300, according to an embodiment. The voltage regulator 300 includes an Ahuja compensated regulator 305, a tracking capacitor Ct 340 and a process tracking circuit 330. The Ahuja compensated regulator 305 is explained now. The Ahuja compensated regulator 305 includes an error amplifier 302. The error amplifier 302 includes an input node 301 and a feedback node 303. The input node 301 receives a reference voltage Vref 304. A pass transistor 308 is coupled to the error amplifier 302. A source terminal 308*s* of the pass transistor 308 is coupled to a supply voltage Vsupply 306. A gate terminal 308*g* of the pass transistor 308 is coupled to the error amplifier 302. An NMOS (n-metal oxide semiconductor) transistor 326 is coupled to the error amplifier 302. A gate terminal 326*g* of the NMOS transistor 326 receives a bias voltage Vbias. A current source 328 is coupled to a source terminal 326*s* of the NMOS transistor 326. One end of the current source 328 is coupled to a ground potential. A compensation capacitor $C_{COMP}$ 314 is coupled between the source terminal 326*s* of the NMOS transistor 326 and a drain terminal 308*d* of the pass transistor 308.

The pass transistor 308 is associated with parasitic capacitances. A first parasitic capacitance $C_{GS}$ 310 is between the source terminal 308*s* and the gate terminal 308*g* of the pass transistor 308. A second parasitic capacitance $C_{GD}$ 312 is between the gate terminal 308*g* and the drain terminal 308*d* of the pass transistor 308. An output node 315 is coupled to the drain terminal 308*d* of the pass transistor 308. A regulated voltage Vout 317 is generated at the output node 315.

A voltage divider circuit 316 is coupled to the drain terminal 308*d* of the pass transistor 308. The voltage divider circuit 316 includes a first resistor R1 318 and a second resistor R2 320. A node 322 between the first resistor R1 318 and the second resistor R2 320 is coupled to the feedback node 303 of the error amplifier 302. One end of the second resistor R2 320 is coupled to the ground potential. The voltage divider circuit 316 and a path 324 form the feedback path of the Ahuja compensated regulator 305.

The process tracking circuit 330 receives the supply voltage Vsupply 306. The tracking capacitor Ct 340 is coupled to the process tracking circuit 330. The feedback path of the Ahuja compensated regulator 305 is coupled to the tracking capacitor Ct 340. The process tracking circuit 330 includes a resistor Rt 332 coupled to the supply voltage Vsupply 306. A PMOS (p-metal oxide semiconductor) transistor 334 is coupled to the resistor Rt 332. A source terminal 334*s* of the PMOS transistor 334 is coupled to the resistor Rt 332. A gate terminal 334*g* of the PMOS transistor 334 receives the bias voltage Vbias.

A diode connected MOS (metal oxide semiconductor) transistor 336 is coupled to a drain terminal 334*d* of the PMOS transistor 334. A drain terminal 336*d* of the diode connected MOS transistor 336 and the drain terminal 334*d* of the PMOS transistor 334 are coupled to the tracking capacitor Ct 340. A source terminal 336*s* of the diode connected MOS transistor 336 is coupled to the ground potential.

The operation of the voltage regulator 300 illustrated in FIG. 1 is explained now. The process tracking circuit 330 injects a voltage at feedback node 303 to cancel the effect of the second parasitic capacitance $C_{GD}$ 312. The process tracking circuit 330 generates a proportional voltage (Vp). When a transconductance of the diode connected MOS transistor 336 is $G_{mos}$, the proportional voltage (Vp) is:

$$Vp = \frac{Vsupply}{G_{mos}Rt} \tag{3}$$

The transconductance ($G_{mos}$) of the diode connected MOS transistor 336 is proportional to a transconductance (gm) of the error amplifier 302. Therefore, the proportional voltage is also defined as:

$$Vp \approx \frac{Vsupply}{gm * Rt} \tag{4}$$

The tracking capacitor Ct 340 generates an injection voltage (Vi) based on the proportional voltage (Vp) received from the process tracking circuit 330. The injection voltage is defined as:

$$Vi = Vp * sCt(R1 \| R2) \tag{5}$$

The injection voltage (Vi) is provided on the feedback path of the Ahuja compensated regulator 305. The feedback node 303 of the error amplifier 302 receives the injection voltage (Vi) and a feedback voltage. The error amplifier 302 amplifies a voltage difference between the reference voltage Vref 304 and a sum of the injection voltage (Vi) and the feedback voltage. The error amplifier 302 on amplification of the voltage difference generates an amplified voltage.

The amplified voltage is provided to the pass transistor 308. The pass transistor 308 also receives a supply voltage Vsupply 306. The regulated voltage Vout 317 is generated at the drain terminal 308*d* of the pass transistor 308 and at the output node 315. The voltage divider circuit 316 receives the regulated voltage Vout 317 and generates the feedback voltage at node 322 which is provided to the error amplifier 302.

The voltage regulator 300 maintains a level of the regulated voltage Vout 317 when the supply voltage Vsupply 306 varies. When the supply voltage Vsupply 306 varies, it causes a change in the level of the regulated voltage Vout 317. The feedback voltage at node 322 varies because of the change in the supply voltage Vsupply 306. In addition, the proportional voltage (Vp) varies in proportion to a change in the supply voltage Vsupply 306. Hence the injection voltage (Vi) is proportional to the change in the supply voltage Vsupply 306. The process tracking circuit 330 mitigates process variations in the voltage regulator 300 arising due to non-ideal conditions during fabrication of the components used in the voltage regulator 300.

The feedback voltage and the injection voltage (Vi) are provided at the feedback node 303, the sum of which is compared with the reference voltage Vref 304. The amplified voltage generated by the error amplifier 302 varies to maintain the level of the regulated voltage Vout 317. The injection voltage (Vi) provides charge to the second parasitic capacitance $C_{GD}$ 312 for the gate terminal 308*g* to track a change in supply voltage Vsupply 306 thus effectively cancelling the second parasitic capacitance $C_{GD}$ 312. The error amplifier 302 then has to provide the residual charge required to move the gate terminal 308*g* to track change in supply voltage Vsupply 306. The process tracking circuit 330, the voltage divider circuit 316 and the tracking capacitor Ct 340 compensates the second parasitic capacitance $C_{GD}$ 312 associated with the pass transistor 308.

The compensation capacitor $C_{COMP}$ 314 stabilizes a response of the feedback path and also improves a phase margin of the feedback path. However, the compensation capacitor $C_{COMP}$ 314 is not in a direct path of the supply voltage Vsupply 306 and the regulated voltage Vout 317. Therefore, a power supply rejection ratio (PSRR) of the voltage regulator 300 is not dependent on the compensation capacitor $C_{COMP}$ 314. As a result, the voltage regulator 300 is capable of high frequency rejection of PSRR. A gain provided by the process tracking circuit 330 is given as:

$$\text{Gain } \alpha \frac{1}{gm * Rt} \tag{6}$$

The gain is proportional to an inverse of a product of the transconductance (gm) of the error amplifier 302 and the impedance (Rt). This gain cancels the second parasitic capacitance $C_{GD}$ 312. The process tracking circuit 330 is a low power circuit. The value of the tracking capacitor Ct 340 is small compared to second parasitic capacitance $C_{GD}$ 312. In one embodiment, the tracking capacitor Ct 340 is given as:

$$Ct = \frac{c_{GD} * gm * Rt}{R_1 || R_2} \tag{7}$$

Feedforward cancellation is thus being performed by the process tracking circuit 330, wherein a deterministic amount of supply noise (injection voltage (Vi)) is being injected from the supply voltage Vsupply 306 to the voltage regulator 300 to cancel a known amount of supply noise inside the voltage regulator 300. Thus, a feedforward cancellation of a deterministic error in the voltage regulator 300 is being performed by the process tracking circuit 330. The process tracking circuit 330 provides a known gain based on the process variation of components inside the voltage regulator 300 to make the feedforward cancellation effective despite process variations. The process tracking circuit 330 provides feedforward cancellation of noise in supply voltage Vsupply 306.

In an example, a corner frequency for PSRR of 6 dB (decibels) is given as:

$$F = \frac{gm}{2\pi Cresidual} \tag{8}$$

where gm is a transconductance of the error amplifier 302 and Cresidual is the capacitance left after cancellation of second parasitic capacitance $C_{GD}$ 312 by the process tracking circuit 330. Cresidual is due to non-ideal cancellation of the second parasitic capacitance $C_{GD}$ 312. The voltage regulator 300 mitigates a variation in supply voltage Vsupply 306 through the process tracking circuit 330 such that a stability of the Ahuja compensated regulator 305 is unaffected by the process tracking circuit 330.

Figure 4:
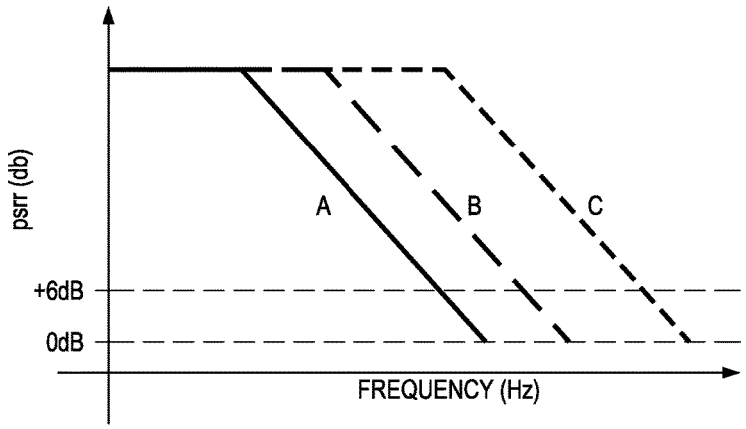
FIG. 4 illustrates responses of the miller compensated regulator (illustrated in FIG. 1), the Ahuja compensated regulator (illustrated in FIG. 2) and the voltage regulator (illustrated in FIG. 3), according to an embodiment.

FIG. 4 illustrates responses of the miller compensated regulator 100 (illustrated in FIG. 1), the Ahuja compensated regulator 200 (illustrated in FIG. 2) and the voltage regulator 300 (illustrated in FIG. 3), according to an embodiment. Curve A represents a response of the miller compensated regulator 100. Curve B represents a response of the Ahuja compensated regulator 200 and curve C represents the response of the voltage regulator 300. As illustrated, the PSRR of the miller compensated regulator 100 degrades at high frequencies as illustrated by curve A. A corner frequency for PSRR of 6 dB (decibels) is inversely proportional to a value of the compensation capacitor $C_{COMP}$. However, the PSRR of the Ahuja compensated regulator 200 is dependent on the second parasitic capacitance $C_{GD}$ 312 which is less than compensation capacitor $C_{COMP}$. Therefore, the PSRR of the Ahuja compensated regulator 200 is better than the miller compensated regulator 100 as illustrated by curve B.

In voltage regulator 300, the tracking capacitor Ct 340 and the process tracking circuit 330 cancels the second parasitic capacitance $C_{GD}$ 312. The PSRR of the voltage regulator 300 is dependent on the residual capacitance after cancellation of the second parasitic capacitance $C_{GD}$ 312 by the tracking capacitor Ct 340. The residual capacitance is less than the second parasitic capacitance $C_{GD}$ 312. In one possible implementation, $C_{GD}$ is 5 pF while residual capacitance Cresidual is 500 fF. Thus, the voltage regulator 300 has better PSRR than the Ahuja compensated regulator 200 as illustrated by curve C.

In the foregoing discussion, the terms "connected" means at least either a direct electrical connection between the devices connected or an indirect connection through one or more passive intermediary devices. The term "circuit" means at least either a single component or a multiplicity of passive or active components, that are connected together to provide a desired function. The term "signal" means at least one current, voltage, charge, data, or other signal. Also, the terms "coupled to" or "couples with" (and the like) are intended to describe either an indirect or direct electrical connection. Thus, if a first device is coupled to a second device, that connection can be through a direct electrical connection, or through an indirect electrical connection via other devices and connections.

One having ordinary skill in the art will understand that the present disclosure, as discussed above, may be practiced with steps and/or operations in a different order, and/or with hardware elements in configurations which are different than those which are disclosed. Therefore, although the disclosure has been described based upon these preferred embodiments, it should be appreciated that certain modifications, variations, and alternative constructions are apparent and well within the spirit and scope of the disclosure. In order to determine the metes and bounds of the disclosure, therefore, reference should be made to the appended claims.

What is claimed is:

1. A circuit to supply a regulated voltage, comprising:

voltage regulator circuitry, including a supply voltage;

an error amplifier with inverting and noninverting inputs, and an output, and an output transistor coupled between the supply voltage and an output node (VOUT), and including a control input coupled to the output of the error amplifier, and configured to provide a regulated output voltage at VOUT, an outer feedback loop coupled between VOUT and the error amplifier noninverting input, an inner feedback loop coupled between VOUT and the error amplifier output, the inner feedback loop including Miller compensation circuitry and Ahuja compensation circuitry;

the error amplifier coupled to receive:

at the noninverting input a feedback voltage corresponding to the regulated output voltage, and at the inverting input, a reference voltage;

a process tracking circuit configured to receive the supply voltage and configured to generate a proportional voltage proportional to a change in the supply voltage;

a tracking capacitor coupled between the process tracking circuit and the outer feedback loop, and configured to generate an injection voltage based on the proportional voltage, the injection voltage proportional to the change in the supply voltage.

2. The circuit of claim 1, wherein:

the process tracking circuit comprises a resistor coupled to the supply voltage; and the proportional voltage is the supply voltage divided by a product of a transconductance of the error amplifier and a resistance of the resistor.

3. The circuit of claim 1, wherein the process tracking circuit further comprises:

a PMOS (p-metal oxide semiconductor) transistor coupled to the resistor, wherein a source terminal of the PMOS transistor is coupled to the resistor and a gate terminal of the PMOS transistor is configured to receive a bias voltage; and a diode connected MOS (metal oxide semiconductor) transistor coupled to a drain terminal of the PMOS transistor, wherein a drain terminal of the diode connected MOS and the drain terminal of the PMOS transistor are coupled to the tracking capacitor.

4. The circuit of claim 3, wherein a transconductance of the diode connected MOS transistor is proportional to the transconductance of the error amplifier.

5. The circuit of claim 1, wherein the error amplifier is configured to amplify a voltage difference between a reference voltage and a sum of the feedback voltage and the injection voltage, and wherein the error amplifier is configured to generate an amplified voltage.

6. The circuit of claim 1, wherein:

the output transistor comprises a pass transistor coupled to the error amplifier, wherein a source terminal of the pass transistor is configured to receive the supply voltage, a gate terminal of the pass transistor is configured to receive the amplified voltage from the error amplifier, and a drain terminal of the pass transistor is connected to VOUT to provide the regulated output voltage;

the Ahuja compensation circuitry in the inner feedback loop comprises:

an NMOS (n-metal oxide semiconductor) transistor coupled to the error amplifier and configured to receive a bias voltage at a gate terminal, and a current source coupled to a source terminal of the NMOS transistor;

the Miller compensation circuitry in the inner feedback loop comprises a Miller compensation capacitor coupled between the source terminal of the NMOS transistor and a drain terminal of the pass transistor; and the outer feedback loop including a voltage divider circuit coupled to a drain terminal of the pass transistor and configured to generate the feedback voltage.

7. The circuit of claim 6, wherein the pass transistor has a first parasitic capacitance between a source terminal and a gate terminal of the pass transistor, and a second parasitic capacitance between the gate terminal and a drain terminal of the pass transistor.

8. The circuit of claim 6, wherein the process tracking circuit, the voltage divider circuit and the tracking capacitor compensates a second parasitic capacitance associated with the pass transistor.

9. A method of supplying a regulated voltage useable in an Ahuja compensated voltage regulator circuit including a supply voltage, an error amplifier with inverting and noninverting inputs, and an output, and an output transistor coupled between the supply voltage and an output node (VOUT), and including a control input coupled to the output of the error amplifier, and configured to provide a regulated output voltage at VOUT, an outer feedback loop coupled between VOUT and the error amplifier noninverting input, an inner feedback loop coupled between VOUT and the error amplifier output, the inner feedback loop including Miller compensation circuitry and Ahuja compensation circuitry; the error amplifier coupled to receive at the noninverting input a feedback voltage corresponding to the regulated output voltage, and at the inverting input, a reference voltage, comprising:

generating a proportional voltage proportional to a change in the supply voltage;

generating an injection voltage for input into the outer feedback loop and the noninverting input to the error amplifier, the injection voltage based on the proportional voltage, and proportional to the change in the supply voltage; and generating the regulated output voltage based on the feedback voltage and the injection voltage.

10. The method of claim 9 further comprising generating an amplified voltage with the error amplifier, wherein the amplified voltage is generated from amplifying a voltage difference between the reference voltage and a sum of the feedback voltage and the injection voltage.

11. The method of claim 9, wherein the injection voltage provide feedforward cancellation of noise in supply voltage.

12. The method of claim 9 further comprising generating the regulated output voltage based on the amplified voltage, wherein the feedback voltage is generated from the regulated output voltage, and the proportional voltage is based on the supply voltage divided by a transconductance of the error amplifier.

13. The method of claim 9, wherein generating the injection voltage further comprises providing the proportional voltage to a tracking capacitor coupled to the outer feedback loop, to generate the injection voltage.

14. The method of claim 9, wherein generating the feedback voltage comprises providing the regulated output voltage to a voltage divider circuit in the outer feedback loop.

15. The method of claim 9, wherein generating the proportional voltage is accomplished with a process tracking circuit comprising:

a PMOS (p-metal oxide semiconductor) transistor coupled to a resistor, wherein a source terminal of the PMOS transistor is coupled to the resistor and a gate terminal of the PMOS transistor is configured to receive a bias voltage; and a diode connected MOS (metal oxide semiconductor) transistor coupled to a drain terminal of the PMOS transistor, wherein a drain terminal of the diode connected MOS and the drain terminal of the PMOS transistor are coupled to the tracking capacitor.

16. The method of claim 15, wherein a transconductance of the diode connected MOS transistor is proportional to the transconductance of the error amplifier.

17. The method of claim 15 further comprising mitigating a variation in supply voltage through the process tracking circuit such that a stability of the Ahuja compensated voltage regulator is unaffected by the process tracking circuit.

18. The method of claim 9, wherein the output transistor comprises a pass transistor, and generating the regulated output voltage comprises providing the amplified voltage at a gate terminal of a pass transistor and the supply voltage at a source terminal of the pass transistor such that the regulated output voltage is generated at a drain terminal of the pass transistor.

19. A voltage regulator including an error amplifier with inverting and noninverting inputs, and an output, and an output PMOS transistor coupled between a supply voltage and an output node (VOUT), and including a control gate coupled to the output of the error amplifier, and configured to provide a regulated output voltage at VOUT, the output PMOS transistor having a first parasitic gate/source capacitance (Cgs) and a second parasitic gate/drain capacitance (Cgd), the voltage regulator comprising:

an outer feedback loop coupled between VOUT and the error amplifier noninverting input;

an inner feedback loop coupled between VOUT and the error amplifier output, the inner feedback loop including Miller compensation circuitry, and Ahuja compensation circuitry;

a process tracking circuit configured to receive the supply voltage and configured to generate a proportional voltage proportional to a change in the supply voltage; and a tracking capacitor coupled between the process tracking circuit and the outer feedback loop, and configured to generate an injection voltage based on the proportional voltage, the injection voltage proportional to the change in the supply voltage;

the Ahuja compensation circuitry configured to compensate for the first parasitic capacitance, and the process tracking circuit, tracking capacitor and injection voltage configured to compensate for the second parasitic capacitance.

20. The voltage regulator of claim 19, wherein, in the inner feedback loop:

the Ahuja compensation circuitry comprises:

an NMOS (n-metal oxide semiconductor) transistor coupled to the error amplifier and configured to receive a bias voltage at a gate terminal, and a current source coupled to a source terminal of the NMOS transistor;

the Miller compensation circuitry comprises a Miller compensation capacitor coupled between the source terminal of the NMOS transistor and a drain terminal of the pass transistor.

21. The voltage regulator of claim 19, wherein:

the process tracking circuit comprises a resistor coupled to the supply voltage; and the proportional voltage is the supply voltage divided by a product of a transconductance of the error amplifier and a resistance of the resistor.

22. The voltage regulator of claim 19, wherein the process tracking circuit further comprises:

a PMOS (p-metal oxide semiconductor) transistor coupled to the resistor, wherein a source terminal of the PMOS transistor is coupled to the resistor and a gate terminal of the PMOS transistor is configured to receive a bias voltage; and a diode connected MOS (metal oxide semiconductor) transistor coupled to a drain terminal of the PMOS transistor, wherein a drain terminal of the diode connected MOS and the drain terminal of the PMOS transistor are coupled to the tracking capacitor.

23. The voltage regulator of claim 22, wherein:

a transconductance of the diode connected MOS transistor is proportional to the transconductance of the error amplifier.

* * * * *